US009642200B2

(12) United States Patent
Caldwell et al.

(10) Patent No.: US 9,642,200 B2
(45) Date of Patent: May 2, 2017

(54) MAINTAINING LED DRIVER OPERATING POINT DURING PWM OFF TIMES

(71) Applicant: LINEAR TECHNOLOGY CORPORATION, Milpitas, CA (US)

(72) Inventors: Joshua William Caldwell, Los Gatos, CA (US); Dongwon Kwon, San Jose, CA (US); Lucas Andrew Milner, San Jose, CA (US)

(73) Assignee: Linear Technology Corporation, Milpitas, CA (US)

( * ) Notice: Subject to any disclaimer, the term of this patent is extended or adjusted under 35 U.S.C. 154(b) by 0 days.

(21) Appl. No.: 15/147,834

(22) Filed: May 5, 2016

(65) Prior Publication Data

US 2016/0353537 A1 Dec. 1, 2016

Related U.S. Application Data

(60) Provisional application No. 62/168,156, filed on May 29, 2015.

(51) Int. Cl.
*H05B 37/00* (2006.01)
*H05B 33/08* (2006.01)

(52) U.S. Cl.
CPC ..... *H05B 33/0842* (2013.01); *H05B 33/0815* (2013.01)

(58) Field of Classification Search
CPC ..... H05B 33/0848; H05B 33/0851
USPC ..... 315/185 R, 246, 291, 308
See application file for complete search history.

(56) References Cited

U.S. PATENT DOCUMENTS 8,248,114 B2 * 8/2012 Russell ..... H05B 33/0818 327/108
8,710,819 B2 * 4/2014 Chen ..... G05F 1/561 323/285

* cited by examiner

*Primary Examiner* — Thuy Vinh Tran
(74) *Attorney, Agent, or Firm* — IntelleTek Law Group, PLLC

(57) ABSTRACT

A method and system of driving an LED load. There is a power stage that is configured to deliver a level of current indicated by a control signal to the LED load when a PWM signal is ON and stop delivering the level of current when the PWM signal is OFF. There is a feedback circuit that is configured to generate the operating point signal, which causes the power stage to deliver a level of current indicated by the control signal, when the PWM signal is ON. A store and hold circuit is configured to store an information indicative of a level of the operating point signal just after the PWM signal is turned OFF and cause the operating point signal to be at that level just before the PWM signal is turned ON.

21 Claims, 7 Drawing Sheets

MAINTAINING LED DRIVER OPERATING POINT DURING PWM OFF TIMES

CROSS-REFERENCE TO RELATED APPLICATION

The present application claims the benefit of priority under 35 U.S.C. §119 from U.S. Provisional Patent Application Ser. No. 62/168,156, entitled "Maintaining LED Driver Operating Point During PWM OFF Times," filed on May 29, 2015, which is hereby incorporated by reference in its entirety for all purposes.

BACKGROUND

Technical Field

This disclosure generally relates to methods and systems of driving light emitting diodes ("LEDs"). More particularly, the present disclosure relates to LED driver circuits that maintain an input reference level for an LED driver power stage.

Description of Related Art

An LED is a P-N junction diode that emits light when a suitable voltage is applied to its leads. To that end, various circuits are used to power an LED. Such circuits not only provide sufficient current to light the LED at the desired brightness and color temperature, but also limit the current to prevent damaging the LED. FIG. 1A illustrates an example of a prior art LED driver circuit 100 that regulates output current 101 to LEDs 115 at a level indicated by a control signal at a control signal input 103 when a pulse width modulation ("PWM") signal at the PWM node 105 is ON (i.e., HI). When the PWM signal is OFF, the output current 101 is zero and the LED load 115 emits no light. Hence, the average value of the output current 101 is controlled by the relative ON and OFF durations of the PWM signal. Put differently, the intensity of the light emitted by the LEDs 115 can be increased with a higher duty cycle and dimmed by lowering the duty cycle of the PWM signal at node 105.

As illustrated in FIG. 1A, an LED driver circuit 100 may include an error amplifier 107 having a control signal input 103, two electronic switches (i.e., the first switch 109 and the second switch 111), an operating point capacitance element 113, an optional output capacitance 117, an LED driver power stage 119, and a current sensor 121.

The error amplifier 107 compares the control input signal at the control signal input node 103 with the output current 101 sensed by the current sensor 121 to generate a signal at its output node 123. This signal 123 provides an operating point signal (e.g., voltage Vc) when the switch 109 is ON. The error amplifier 107 adjusts the operating point to reduce the error signal between the control signal input 103 and a voltage representation of the current that is flowing through the LED load 115. The voltage at the operating point signal node Vc is used by the LED driver power stage 119 to set the amount of output current 101 that is delivered to the LEDs 115. Thus, the signal 123 at the output of the error amplifier provides an operating point for the LED driver circuit 119 for the amount of output current 101 to match the amount indicated by the control signal at the control signal input 103 of the error amplifier 107.

The capacitance element 113 may therefore be referred to as an operating point capacitance because the voltage across it (i.e., the operating point signal) represents the input operating point signal to the LED driver power stage 119 that is used to cause the output current 101 to the LEDs 115 to be equal to the amount indicated by the control signal 103. The operating point capacitance element 113 stores the operating point signal of node Vc for the LED driver circuit 119. Thus, the capacitance element 113 stores the operating point of the power stage 119 such that the current in the LED load 115 is regulated to the CTRL input 103 of the error amplifier 107. The capacitance element 113 may also function to stabilize the LED current feedback control loop. In this regard, the capacitance of the capacitance element 113 may be limited in maximum value.

The features of the LED driver circuit 100 may be better understood in view of FIG. 1B, which illustrates some example waveforms of the LED driver circuit 100. Ideally, the capacitance element 113 should hold the voltage of the operating point signal Vc when the switch 109 is OFF (i.e., open), to keep the operating point signal Vc stable for the LED driver power stage 119. However, under real world conditions, the voltage across the operating point capacitance element 113 decays (i.e., loses charge) during OFF periods of the PWM signal at node 105 due to internal leakage and/or leakage of any circuits connected to the operating point capacitance element 113, including the first switch 109. The voltage drop becomes more significant as the PWM OFF duration increases. After a long PWM OFF time (e.g., more than 1 second), for example, the operating point signal Vc across the operating point capacitance element 113 may be lower than its value when (e.g., just after) the PWM signal is turned OFF. Put differently, the value of the operating point signal Vc is higher at the transition point when the PWM is turned OFF, than the value after a long PWM OFF time. When the PWM signal 105 is turned back ON after a long PWM OFF period, the LED driver power stage 119 may be subject to a recovery time until the voltage across the operating point capacitance element 113 has returned to its original operating point signal Vc.

Such a delay can be problematic in applications that desire the color temperature and/or the intensity of the LEDs 115 to be at a predetermined level immediately after they are turned ON. Traditional approaches of having longer PWM ON time to include the recovery delay in addition to the desired LED load ON time not only increases power consumption but may not be effective because the recovery delay may vary with the size of the operating point capacitance element 113, process, temperature, desired LED light intensity, and the PWM OFF durations.

BRIEF DESCRIPTION OF DRAWINGS

The drawings are of illustrative embodiments. They do not illustrate all embodiments. Other embodiments may be used in addition or instead. Details that may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF ILLUSTRATIVE EMBODIMENTS

In the following detailed description, numerous specific details are set forth by way of examples in order to provide a thorough understanding of the relevant teachings. However, it should be apparent that the present teachings may be practiced without such details. In other instances, well-known methods, procedures, components, and/or circuitry have been described at a relatively high-level, without detail, in order to avoid unnecessarily obscuring aspects of the present teachings. Some embodiments may be practiced with additional components or steps and/or without all of the components or steps that are described.

The various methods and circuits disclosed herein generally relate to methods and circuits of maintaining an input reference level for an LED driver power stage such that recovery time is substantially reduced or eliminated. The power stage is configured to deliver a level of current indicated by a control signal to an LED load when the PWM signal is ON and stop delivering the level of current when the PWM signal is OFF. A feedback circuit is configured to generate the operating point signal to cause the power stage to deliver a level of current indicated by the control signal, when the PWM signal is ON. A store and hold circuit is configured to store information indicative of a level of the operating point signal when (e.g., just after) the PWM signal is turned OFF and causes the operating point signal to be at that level when the PWM signal turns back ON (e.g., returns to an ON state).

Figure 1A:
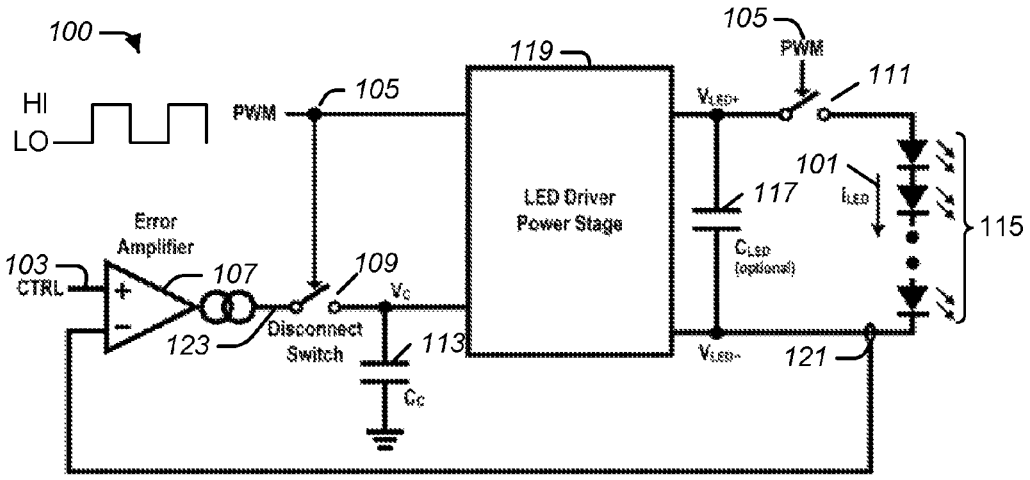
FIG. 1A (Prior Art)
FIG. 1A illustrates an example of a prior art light emitting diode (LED) driver circuit.
Figure 1B:
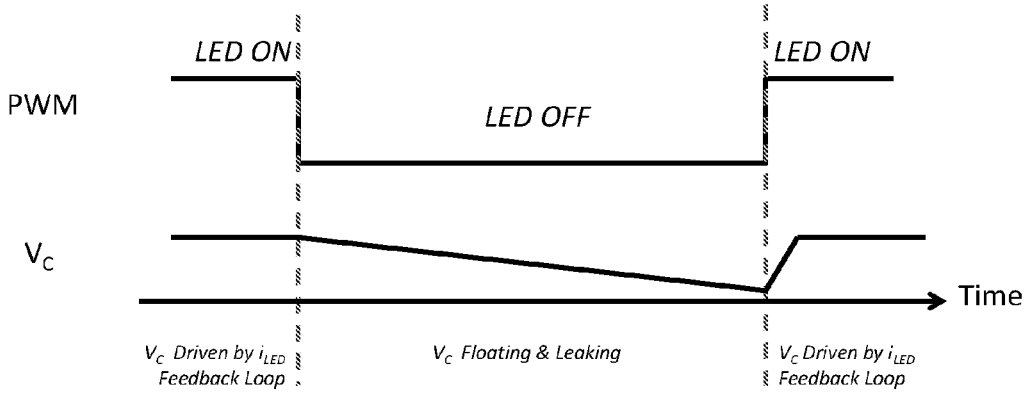
FIG. 1B (Prior Art)
FIG. 1B illustrates example waveforms of the LED driver circuit of FIG. 1A.
Figure 2:
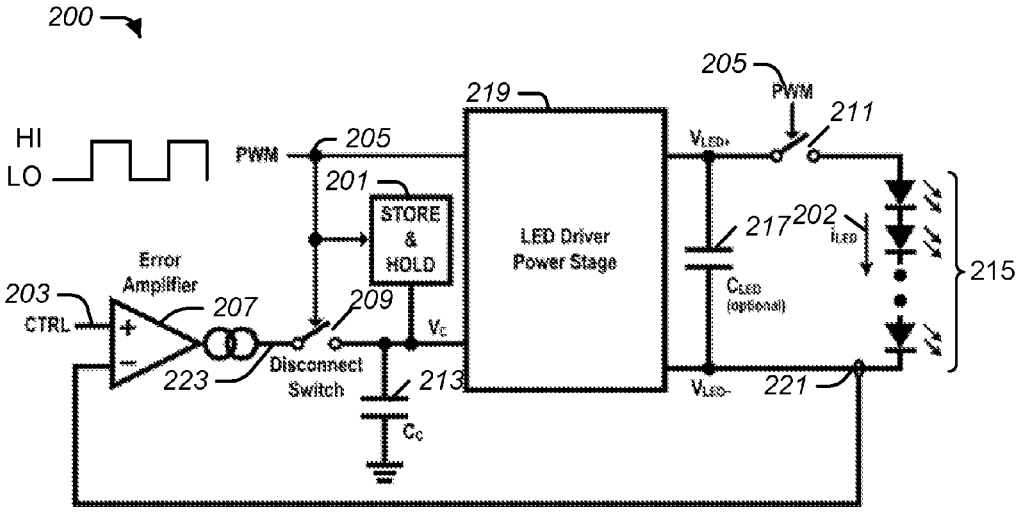
FIG. 2 illustrates an example of an LED driver circuit that maintains a voltage across an operating point capacitance element while a PWM signal is OFF, consistent with an exemplary embodiment.

FIG. 2 illustrates an example of an LED driver circuit 200 that maintains a voltage across an operating point capacitance element 213 while a PWM signal is OFF, consistent with an exemplary embodiment. LED driver circuit 200 may include an error amplifier 207 having a control signal input 203, two electronic switches (i.e., the first switch 209 and the second switch 211), an LED driver power stage 219, and a current sensor 221. There may be an operating point capacitance element 213 and an optional output capacitance element 217.

The error amplifier 207 has a first input (e.g., positive terminal) coupled to a control signal and a second input (e.g., negative terminal) coupled to a current sensor 221. The error amplifier 207 has an output node 223 coupled to the input of the first switch 209, sometimes referred to herein as the disconnect switch. In various embodiments, the error amplifier 207 may provide a current or voltage at its output 223. For discussion purposes, it will be assumed that output 223 provides a current that is passed through the switch 209 to create an operating point signal Vc.

The first switch 209 has an input node coupled to the output node 223 of the error amplifier 207, an output node coupled to the operating point signal node Vc, and a control node coupled to the PWM signal node 205. There is a store and hold circuit 201 that is coupled to the operating point signal node Vc. The store and hold circuit 201 has an input that is coupled to the PWM node, such that the store and hold circuit 201 is controlled by the PWM signal.

The LED driver power stage 219 has a first input coupled to the PWM node 205 and a second input coupled to the operating point signal node Vc. The LED driver power stage 219 has a differential output including a first output (e.g., $V_{LED+}$) and a second output (e.g., $V_{LED-}$). In one embodiment, there is an optional output capacitance element 217 coupled between the first and second outputs of the LED driver power stage 219. The output capacitance element 217 may filter high frequency AC currents and voltages and reduce the current ripple through the LED load 215, thereby increasing operational lifetime of the LED load 215 when the PWM is ON. It also maintains the output voltage of the LED driver power stage 219 when the PWM is OFF.

Further, the LED load 215, which may include one or more LEDs, is coupled between the first and second outputs of the LED driver power stage 219. While the LEDs in circuit 200 are illustrated by way of example to be connected in series, it will be understood that, in various embodiments, there may be a single LED, the LEDs may be connected in parallel, or the LEDs may be connected in any suitable series/parallel combination to implement a desired output.

The second switch 211 has an input coupled to the first output $V_{LED+}$ of the LED driver power stage 219 and an output coupled to the input of the LED load 215. The control node of the second switch 211 is coupled to the PWM node 205.

When the PWM signal 205 is ON (i.e., at a "HI" level), the ON voltage from the PWM signal at node 205 may drive both of the electronic switches 209 and 211 to a closed state (ON), thereby allowing signals to propagate through switches 209 and 211, respectively. During this ON time, the error amplifier 207, the LED driver power stage 219, the operating point capacitance element 213, and the output capacitance 217 may operate in a feedback loop. The feedback loop may cause the current to the LEDs 215 to match a level indicated by the control input signal at the first input node 203 of the error amplifier 207.

For example, the feedback circuit is configured to determine the current that is flowing through the LED load 215 and compare a voltage representation of this current to the control signal at control node 203 to provide the operating point signal to the second input of the power stage 219 when the PWM signal is ON. Thus, the error amplifier 207 compares the control input signal at the control signal input node 203 with the output current 202 sensed by the current sensor 221. In one embodiment, the control signal is a voltage and the output current 202 sensed by the current sensor 221 is provided to the second input of the error amplifier as a voltage. Put differently, the current signal sensed by the current sensor 221 is converted to a voltage, such that the error amplifier 207 can compare the control input signal 203 to a voltage representation of the current 202 flowing through the LED load 215.

It should be noted that the feedback circuit of the feedback loop includes the current 221 sensor that may be coupled to a second terminal (e.g., $V_{LED}-$) of the differential output of the power stage 219. In other embodiments, the current sensor 221 may be placed in any suitable location so as to sense the current through the LED load 215. The feedback circuit further includes the error amplifier 203 having a first input coupled to the control signal 203, a second input coupled to the current sensor 221, and an output coupled to the second input of the power stage via a first switch 209.

The error amplifier 207 provides an operating point signal Vc 223 when the first switch 209 is ON. The operating point signal Vc is used by the LED driver power stage 219 to set the amount of output current 202 that is delivered to the LEDs 215. Thus, the error amplifier 207 provides an operating point for the LED driver circuit 219 for the amount of output current 202 to match the amount indicated by the control signal at the control signal input 203 of the error amplifier 207.

The operating point capacitance element 213 stores the operating point signal Vc for the LED driver power stage 219 and may be used to provide feedback stability. In various embodiments, the operating point capacitance may be implemented as an external component (e.g., typically <10 nF) or implemented on the same integrated circuit as the store and hold circuit 201 (e.g., typically <100 pF).

When the PWM signal 205 is turned OFF (i.e., at "LO" level), it causes both of the electronic switches 211 and 209 to open, and therefore prevent signals to propagate through switches 209 and 211, respectively. Accordingly, when the PWM is OFF, the delivery of energy to the LEDs 215 from the LED driver power stage 219 is prevented.

The store and hold circuit 201 is configured to preserve the operating point voltage Vc on the operating point capacitance element 213 when the PWM signal is OFF. For example, when the PWM signal is ON, the voltage across the operating point capacitance element 213 may be stored within the store and hold circuit 201. During the PWM ON time, the store and hold circuit 201 does not have a significant effect on the LED driver circuit 219. The store and hold circuit 201 may operate in store mode during the PWM ON time, without effect on the operating point voltage Vc. The store and hold circuit 201 may also operate to store and then hold just after the PWM signal has transitioned to the OFF state.

For example, when the PWM signal 205 is OFF, the first and second switches (209 and 211) are open. Accordingly, the second switch 211 disconnects the LED load 215 from the output of the LED driver power stage 219 and the first switch 209 disconnects the operating point capacitance element 213 from the feedback path of the error amplifier 207. However, the store-and-hold circuit 201 remains coupled to the second input of LED driver power stage 219 that is coupled to the operating point signal node Vc.

During this PWM OFF time, the store-and-hold circuit 201 maintains the operating point signal Vc across the operating point capacitance element 213 by providing a stored value of the operating point signal Vc as a reference. Because of this voltage maintenance provided by the store and hold circuit 201, the voltage across the operating point capacitance element 213 remains at the desired level during OFF times of the PWM signal. Thus, by virtue of the store and hold circuit 201, the operating point voltage Vc is preserved over long periods of PWM OFF time (e.g., over 1 sec.) and the LED driver circuit 200 is no longer subject to the voltage decay of the operating point capacitance element 213. Accordingly, the LED driver circuit 200 is configured to quickly return to or maintain the desired operating point, as defined by the operating point signal Vc when the PWM is ON, each time the PWM signal is turned back ON, even after long PWM OFF periods.

Example Store and Hold Circuits

Figure 3A:
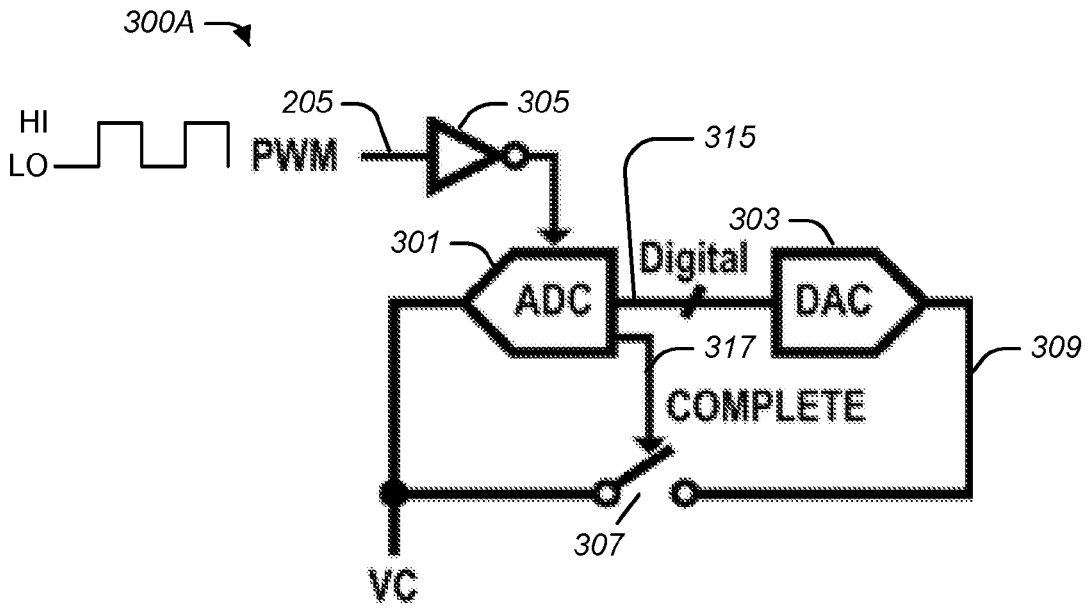
FIGS. 3A and 3B illustrate examples of circuits that maintain the operating point information in a digital code, which may be used to implement the store and hold circuit of FIG. 2.
Figure 3B:
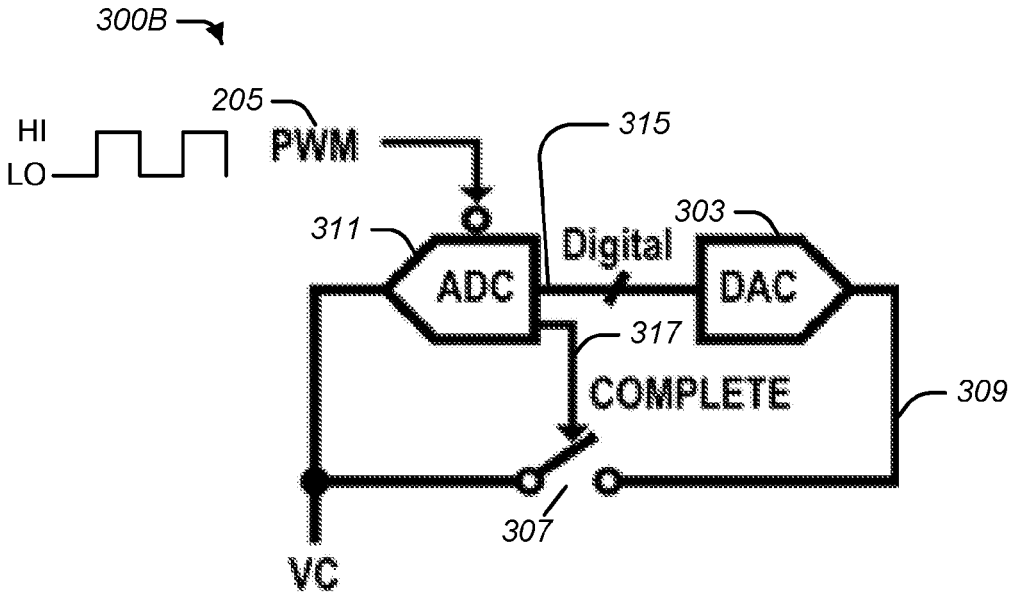

In various embodiments, the store and hold circuit 201 may be a digital circuit, an analog circuit, or a combination thereof. FIGS. 3A and 3B illustrate examples of circuits that maintain the operating point information in a digital code, which may be used to implement the store and hold circuit 201 of FIG. 2. As illustrated in FIG. 3A, the digital store and hold circuit 300A may include an analog to digital converter (ADC) 301, a digital to analog converter (DAC) 303, an inverter 305, and an electronic switch 307. The digital store and hold circuit 300B of FIG. 3B has substantially similar features, except that the ADC 311 is active low and therefore does not need the inverter 305 of FIG. 3A. Accordingly, the features of the store and hold circuit 300B of FIG. 3B will not be repeated for brevity.

In FIG. 3A, the digital store and hold circuit 300A has an ADC 301 that has a first input coupled to the operating point signal Vc, a second input coupled to the PWM signal node 205, and a first output 315 coupled to the input of the DAC 303. In one embodiment, the ADC 301 has a separate output node 317 coupled to the control node of the switch 307.

In various embodiments, the ADC 301 may be active high or low. If the ADC 301 is active high, there may be an inverter 305 coupled between the PWM input node 205 and the second input of the ADC 301.

The digital store and hold circuit 300A also includes a switch 307 that is coupled between the operating point signal node Vc and the output of the DAC 303. The control node of the switch 307 may be controlled by the second output of the ADC.

Figure 3C:
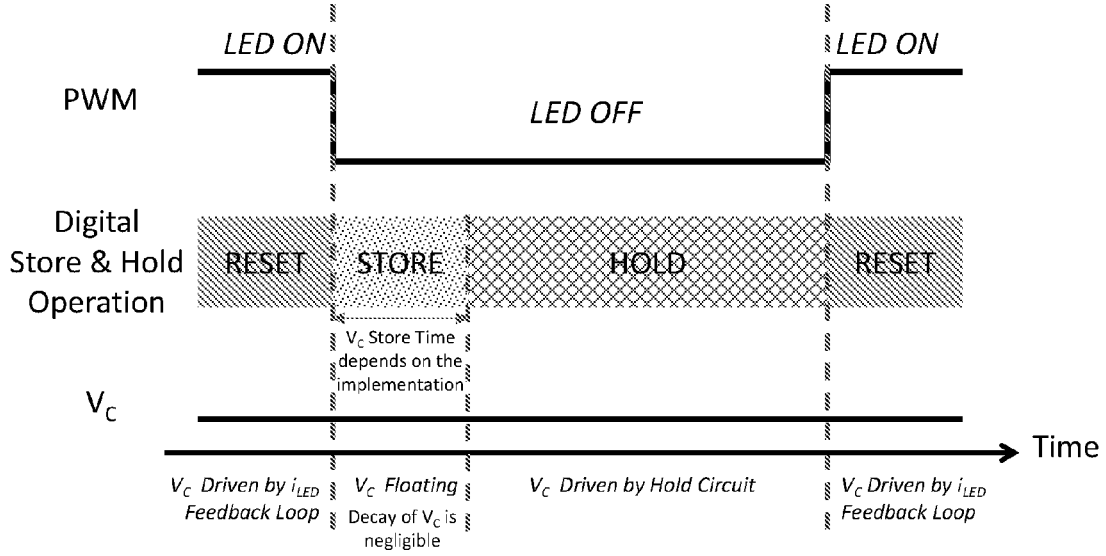
FIG. 3C illustrates example waveforms of the digital store and hold circuits of FIGS. 3A and 3B.

The features of the digital store and hold circuit 300A may be better understood in view of FIG. 3C, which illustrates some example waveforms of the digital store and hold circuits 300A and 300B. When the PWM signal at node 205 is OFF, the inverted PWM signal turns ON the ADC 301, which allows the ADC 301 to convert the voltage across the operating point capacitance element 213 of FIG. 2, namely the operating point signal Vc, into a digital number at its output 315. That digital number may be stored in a storage memory, which may be part of the ADC 301 or separate therefrom. Because digitally stored values do not drift over time, the operating point voltage Vc can be maintained.

The digital output of the memory that is holding the operating point voltage information may be coupled to an input of the DAC 303. To facilitate this discussion, it will be assumed that the memory that is holding the operating point voltage is in the ADC. The DAC is configured to receive the digital signal at its input node 315 and provide an analog version thereof at its output node 309. After the PWM signal at node 205 is turned OFF and the analog to digital conversion is completed by the ADC 301, the digital store and hold circuit 300A closes the electronic switch 307, thereby providing a path from the output 309 of the DAC 303 to the operating point voltage node $V_c$. Accordingly, the stored operating point voltage Vc is delivered back across the operating point capacitance element 213. It should be noted that since the operation of an ADC and/or DAC is relatively quick, the voltage decay of the operating point voltage Vc across the capacitance element Cc 213 is negligible. Thus, the operating point voltage Vc that is delivered by the DAC 303 is substantially similar to the operating point voltage Vc over the operating point capacitor 213 when the PWM was ON.

In various embodiments, the DAC 303 may be operated continuously for better speed, or may be turned ON immediately at (or slightly before) the switch 307 is turned ON, to conserve power, while providing sufficient time for the DAC 303 to convert the digital signal to an analog signal.

Different types of ADCs can be used to implement the ADC 311 of digital store and hold circuits 300A and 300B, depending on the specific requirements of the LED driver circuit. The ADCs discussed herein operate under the common principle of converting a continuous signal into a certain number of bits N. The more bits used, the better the precision of the ADC. Common types of ADCs include pipelined, flash, successive-approximations register (SAR), sigma delta (ΣΔ), and integrating or dual slope.

As illustrated in FIGS. 3A/B, a digital store and hold circuit may include one or more appropriately configured DACs to convert digital signals to the analog domain. To that end, in various embodiments, different DACs can be used, including but not limited to, pulse-width modulator, delta-sigma (ΣΔ), binary-weighted, resistor to resistor (R-2R) ladder, successive-approximations register, thermometer-coded, and hybrid (which may use a combination of the aforementioned DACs). These DACs are operative to convert a finite number into a physical quantity in the form of a current or voltage.

As illustrated in FIG. 3C, the operating point voltage Vc is stored in a digital code after the PWM signal is OFF. For example, when the PWM is ON, the LED load is ON, while the digital store and hold circuit is reset. During this time, the operating point voltage Vc is driven by the $i_{LED}$ current feedback loop. When the PWM is OFF, the LED load is turned OFF and the digital store and hold circuit enters an initial "store" state. The duration of the store time depends on the specific implementation. During the "store" state, the operating point voltage Vc is floating and the decay of the voltage across the operating point capacitance element Cc is negligible. When the store process is complete, the operating point voltage can be driven by the digital store and hold circuit for the remainder of the PWM OFF time.

Figure 4A:
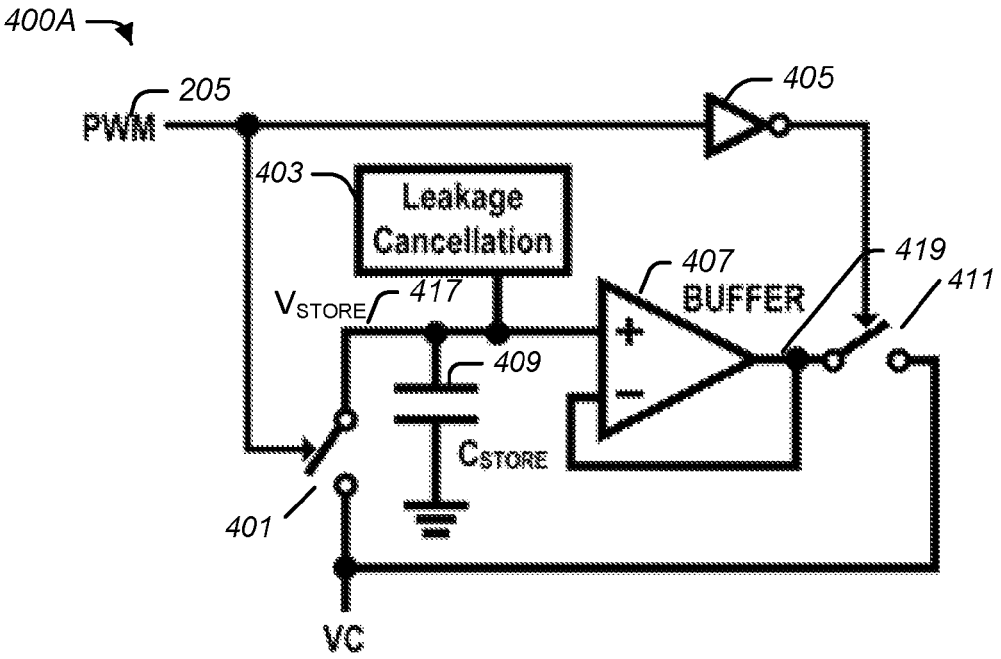
FIGS. 4A and 4B illustrate examples of circuits that maintain the operating point information as an analog voltage, which may be used to implement the store and hold circuit of FIG. 2
Figure 4B:
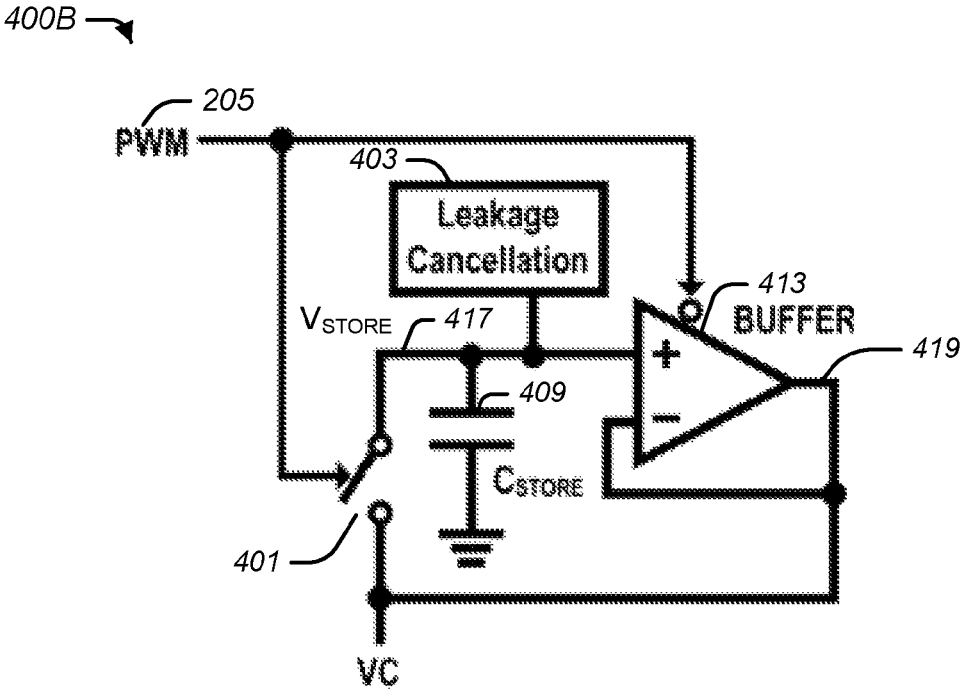

As mentioned previously, in some embodiments, the store and hold circuit discussed herein can also maintain the operating point information as an analog voltage. Analog implementations may require less chip area, consume less power, and be simpler to implement in that several blocks, such as an ADC and a DAC are eliminated. To that end, FIGS. 4A and 4B illustrate examples of analog circuits that may be used to implement the store and hold circuit 201 illustrated in FIG. 2. As illustrated in FIG. 4A, the analog store and hold circuit 400A includes a first switch 401, a leakage cancellation circuit 403, an amplifier 407, and a storage capacitance element 409. The local storage capacitance element 409 may be integrated on the same chip, although external capacitance elements are envisioned as well. In one embodiment, the local storage capacitance element 409 is substantially smaller (e.g., a factor of 10 or smaller) than the operating point capacitance element 213.

In various embodiments, the amplifier 407 may be turned ON or OFF itself to conserve power and/or there may be a second switch 411 at the output of the amplifier 407. When a second switch 411 is used, there may be an inverter 405 coupled between the PWM input node 205 and the control node of the second switch 411. The analog store and hold circuit 400B of FIG. 4B has substantially similar features, except that it does not have the second switch 411 and inverter 405. Instead, the amplifier 407B is controlled directly by the PWM signal at node 205.

The leakage cancellation circuit is coupled to the first (e.g., positive) input 417 of the amplifier 407. The amplifier 407 may be configured as a unity gain buffer in that it has its second input (e.g., negative) coupled to its output at node 419. Accordingly, the voltage at node 417 is substantially similar to the voltage at node 419 since the gain of the amplifier 407 is sufficiently high. The output of the amplifier output node 419 is coupled to the operating point signal Vc (e.g., via the switch 411). The first switch 401 has a first node that is coupled to the first (i.e., non-inverting) input of the amplifier 407 and a second input that is coupled to the operating point signal node Vc. The storage capacitor is also coupled to the non-inverting input of the amplifier 407.

Each of the first and second switches has a control node that is coupled to the PWM node 205. The first switch 401 is configured to be in a closed state (i.e., ON) when the PWM signal 205 is high (i.e., ON), and open (i.e., OFF) when the PWM signal 205 is low (i.e., OFF). Conversely, the second switch 411 is configured to be OFF when the PWM signal 205 is ON, and to be ON when the PWM signal 205 is OFF. Thus, the amplifiers 407 and 413 are configured to be deactivated when the PWM signal 205 is ON and activated when it is OFF.

Figure 4C:
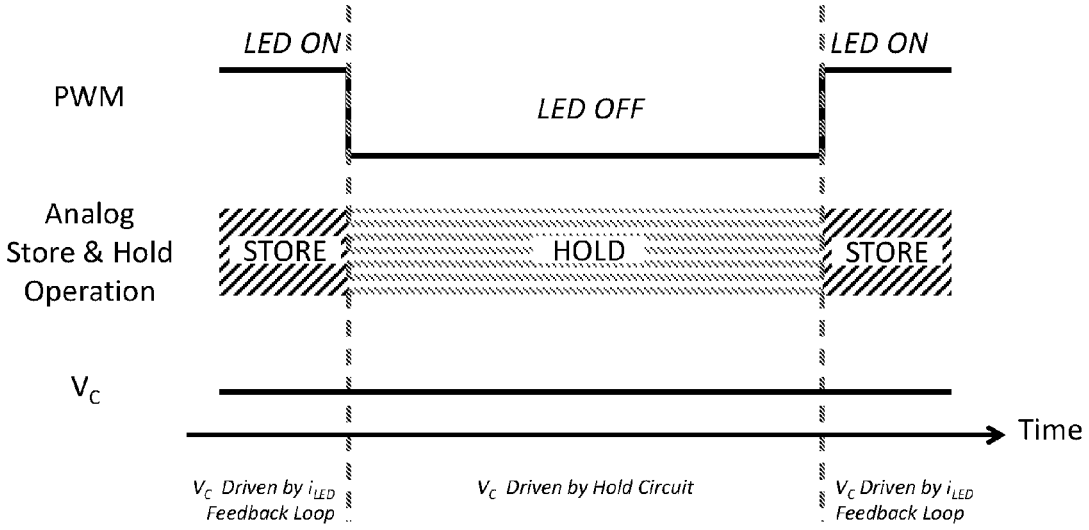
FIG. 4C illustrates example waveforms of the analog store and hold circuits of FIGS. 4A and 4B.

The features of the store and hold circuit 400A and 400B may be better understood in view of FIG. 4C, which illustrates some example waveforms of the store and hold circuits 400A and 400B. In circuits 400A and 400B of FIGS. 4A and 4B, when the PWM signal at node 205 is ON, the first switch 401 closes, allowing a path from the operating point capacitance element 213 to the local storage capacitance element 409. Put differently, the voltage at operating point signal node Vc is stored across the local storage capacitance element 409.

When the PWM signal at node 205 is OFF, the first switch 401 opens (i.e., OFF), thereby severing the path between the operating point signal node Vc and the local storage capacitance element 409 at node 417. However, since there is an inverse relationship between the first switch 401 and the second switch 411, the second switch 411 is now closed (i.e., ON), thereby allowing a path between the output of the amplifier 407 and the operating point signal at node Vc, which is provided across the operating point capacitance element 213. This operating point signal that is provided by the output of the amplifier 407 is substantially similar to that of the operating point signal node Vc stored across the operating point capacitance element 213 when (e.g., just after) the PWM is turned OFF. Put differently, the operating point signal that is provided by the output of the amplifier 407 is substantially similar to a value of the operating point signal when the PWM signal transitions from ON to OFF. By virtue of using the local storage capacitance element 409, which has a known capacitance, a more stable reference voltage can be provided.

In one embodiment, there is a leakage cancellation circuit 403 that is configured to further maintain the voltage stored across the local storage capacitance element 409 at node 417 when the PWM signal at node 205 is OFF. Put differently, the voltage across the local storage capacitance element 409 does not degrade over time when the PWM signal at node 205 is OFF.

As illustrated in FIG. 4C, the operating point voltage Vc can be held as an analog voltage after the PWM signal is OFF. The "store" step can be performed when the PWM signal is ON. During this time, the LED is ON and the operating point voltage Vc is driven by the $i_{LED}$ current feedback loop. When the PWM is OFF, the LED is turned OFF and the store and hold circuit enters a hold state, where the operating point voltage Vc is driven by the store and hold circuit.

Figure 5A:
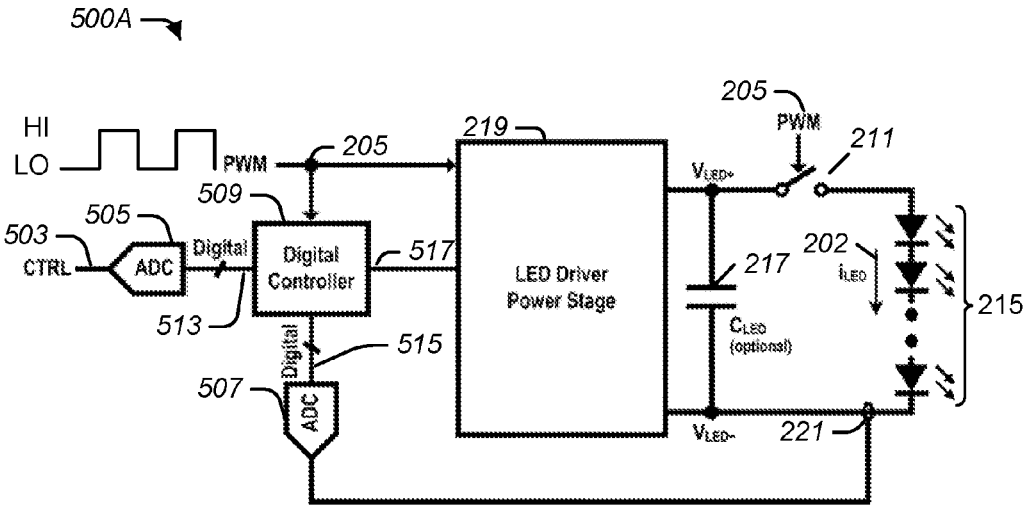
FIGS. 5A and 5B illustrate LED driver circuits that use a digital controller to maintain the operating point information for an analog LED driver power stage, consistent with exemplary embodiments.
Figure 5B:
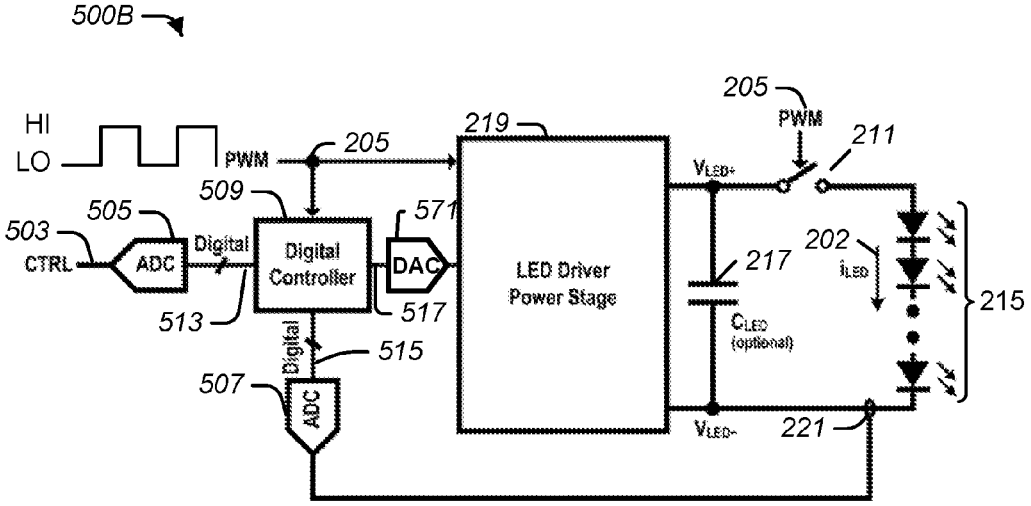

Reference now is made to FIGS. 5A and 5B, which illustrate LED driver circuits that use a digital controller 509 to maintain the operating point information for an analog LED driver power stage 219, consistent with exemplary embodiments. Some features of the LED driver circuits 500A and 500B are similar to those of LED driver circuit 200 of FIG. 2 and are therefore not repeated for brevity. Accordingly, the discussion below highlights some distinguishing features. Further, the LED driver circuit 500B of FIG. 5B is substantially similar to the LED driver circuit 500A of FIG. 5A except that it has an additional DAC 571 coupled between the digital controller 509 and the LED driver power stage 219. Accordingly, the features of LED driver circuit 500B will not be repeated for brevity.

The LED driver circuit 500A includes a digital controller 509 that is configured to control the current that is provided by the LED driver power stage 219 to the LED load 215. The digital controller has a first input that is coupled to the PWM node 205, a second input 513 that is coupled to a first digital signal, and a third input that is coupled to a second digital input 515. There is an ADC 505 coupled between the control node CTRL 503 and the second input of the digital controller. There is a second ADC 507 coupled between a current sensor 221 and the third input of the digital controller 509.

The LED driver circuit 500A converts the analog CTRL signal to a digital signal via the ADC 505. The current sensor 221 senses the current that flows through the LED load 215 (e.g., current 202), which is converted to a digital signal via the ADC 507. The digital controller 509 compares the digital signal at its second input 513 to the digital signal at its third input 515 and generates a digital signal at its output 517 to control the LED driver power stage 219. In the LED driver circuit 500A, the digital operating point information is saved when (e.g., just after) the PWM signal at node 205 is turned OFF to expedite the LED current recovery when the PWM signal is turned back ON.

CONCLUSION

The components, steps, features, objects, benefits, and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, objects, benefits, and/or advantages. These also include embodiments in which the components and/or steps are arranged and/or ordered differently.

For example, any signal discussed herein may be scaled, buffered, scaled and buffered, converted to another mode (e.g., voltage, current, charge, time, etc.,), or converted to another state (e.g., from HIGH to LOW and LOW to HIGH) without materially changing the underlying control method.

In view of the discussion herein, the proposed techniques of maintaining the operating point voltage during inactive durations of a system to expedite the recovery can be applied to other applications that can be driven by current pulses, such as motor drivers.

Another variation of the proposed techniques may regulate the operating point voltage during a PWM OFF time at a different level than the one during a PWM ON time. Depending on the load impedances, the operating point voltage can be maintained at a higher or lower level during the PWM OFF times to generate a desired recovery response when the PWM returns to an ON state.

Unless otherwise stated, all measurements, values, ratings, positions, magnitudes, sizes, and other specifications that are set forth in this specification, are approximate, not exact. They are intended to have a reasonable range that is consistent with the functions to which they relate and with what is customary in the art to which they pertain.

Except as stated immediately above, nothing that has been stated or illustrated is intended or should be interpreted to cause a dedication of any component, step, feature, object, benefit, advantage, or equivalent to the public, regardless of whether it is or is not recited in the claims.

All articles, patents, patent applications, and other publications that have been cited in this disclosure are incorporated herein by reference.

It will be understood that the terms and expressions used herein have the ordinary meaning as is accorded to such terms and expressions with respect to their corresponding respective areas of inquiry and study except where specific meanings have otherwise been set forth herein. Relational terms such as "first" and "second" and the like may be used solely to distinguish one entity or action from another, without necessarily requiring or implying any actual relationship or order between them. The terms "comprises," "comprising," and any other variation thereof when used in connection with a list of elements in the specification or claims are intended to indicate that the list is not exclusive and that other elements may be included. Similarly, an element preceded by an "a" or an "an" does not, without further constraints, preclude the existence of additional elements of the identical type.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A light emitting diode (LED) driver circuit comprising:

a control signal input configured to receive a control signal;

a pulse-width modulation (PWM) input configured to receive a PWM signal;

a power stage having a first input coupled to the PWM input, a second input configured to receive an operating point signal, and an output, wherein the power stage is configured to deliver a level of current indicated by the control signal, to a light emitting diode (LED) load when the PWM signal is ON and stop delivering the level of current when the PWM signal is OFF;

a feedback circuit coupled between the output and the second input of the power stage, wherein the feedback circuit is configured to generate the operating point signal to cause the power stage to deliver a level of current indicated by the control signal, when the PWM signal is ON;

a store and hold circuit having a first node coupled to the PWM input and a second node coupled to the second input of the power stage, wherein the store and hold circuit is configured to store an information indicative of a level of the operating point signal just after the PWM signal is turned OFF and cause the operating point signal to be at that level just before the PWM signal is turned ON.

2. The LED driver circuit of claim 1, wherein the feedback circuit is configured to determine a first current that is flowing through the LED load and compare a voltage representation of the first current to the control signal to provide the operating point signal to the second input of the power stage when the PWM signal is ON.

3. The LED driver circuit of claim 2, wherein the feedback circuit comprises:

a current sensor coupled to a second terminal of the differential output of the power stage; and an error amplifier having a first input coupled to the control signal input, a second input coupled to the current sensor, and an output coupled to the second input of the power stage via a first switch.

4. The LED driver circuit of claim 2, further comprising an operating point capacitance element coupled between the second input of the power stage and a ground, wherein the operating point capacitance element is configured to store a level of the operating point signal and to stabilize the feedback circuit.

5. The LED driver circuit of claim 2, wherein the store and hold circuit is configured to maintain an operating point information, based on the operating point signal, in a digital code.

6. The LED driver circuit of claim 5, wherein the store and hold circuit comprises:

an analog to digital converter (ADC) configured to convert the operating point signal to a first digital signal, the ADC comprising:

an input coupled to the second input of the power stage;

a second input coupled to the PWM input;

a first output configured to provide the first digital signal; and a second output;

a digital to analog converter (DAC) configured to convert the first digital signal to a first analog signal, the DAC comprising:

an input coupled to the first output of the ADC; and an output configured to provide the first analog signal; and a switch comprising:

a first node coupled to the output of the DAC;

a second node coupled to the second input of the power stage; and a control node coupled to the second output of the ADC.

7. The LED driver circuit of claim 6, wherein the control node at the output of the ADC turns ON when the PWM signal is turned OFF and the analog to digital conversion of the ADC is complete.

8. The LED driver circuit of claim 2, wherein the store and hold circuit is configured to maintain an operating point information, based on the operating point signal, as an analog voltage.

9. The LED driver circuit of claim 8, wherein the store and hold circuit comprises:

a first amplifier having positive input coupled to a storage node, a negative input, and an output coupled to the negative input of the first amplifier, wherein the first amplifier is configured to provide the operating point signal when the PWM signal is OFF and stop delivering the operating point signal when the PWM signal is ON;

a storage capacitance element having a first node coupled to the storage node and a second node coupled to a ground;

a first switch coupled between the storage node and the second node of the power stage, wherein the first switch is configured to provide the operating signal to the positive input of the amplifier when the PWM signal is ON.

10. The LED driver circuit of claim 9, further comprising a leakage cancellation circuit coupled to the storage node.

11. The LED driver circuit of claim 10, wherein the leakage cancellation circuit is configured to replenish a leakage current of the storage capacitor of the store and hold circuit.

12. The LED driver circuit of claim 9, further comprising an operating point capacitance element coupled between the second input of the power stage and the ground, wherein:

the operating point capacitance element is configured to store a voltage level of the operating point signal;

the storage capacitance element has a capacitance that is less than a capacitance of the operating point capacitance element.

13. The LED driver circuit of claim 12, wherein the storage capacitance element is further configured to stabilize the feedback circuit.

14. A method of driving light emitting diode (LED) load with a circuit including a power stage, a feedback circuit, and a store and hold circuit, the method comprising:

receiving, by the power stage, a PWM signal and an operating point signal;

providing a level of current indicated by a control signal, to the LED load when the PWM signal is ON and stop delivering the level of current when the PWM signal is OFF;

causing the feedback circuit to generate the operating point signal by:

determining a current flowing through the LED load;

creating a voltage representation of the current flowing through the LED load; and comparing the control signal to the voltage representation of the current flowing through the LED load; and storing, by the store and hold circuit, an information indicative of a level of the operating point signal just after the PWM signal is turned OFF; and causing the operating point signal to be at that level just before the PWM signal is turned ON.

15. The method of claim 14, further comprising receiving the level of the operating point signal when the PWM signal is ON and providing the level of the operating point signal when the PWM is OFF.

16. The method of claim 15, further comprising stabilizing the feedback circuit on an operating point capacitance element.

17. The method of claim 14, further comprising storing the voltage level of the operating point signal.

18. The method of claim 14, further comprising:

converting the operating point signal to a first digital signal;

storing the first digital signal;

converting the first digital signal into an analog signal; and providing the analog signal as the operating point signal after the PWM is OFF to maintain a voltage across an operating point capacitance element.

19. The method of claim 14, wherein the storing the information indicative of the level of the operating point signal by store and hold circuit comprises:

a first amplifier having positive input coupled to a storage node, a negative input, and an output coupled to the negative input of the first amplifier, wherein the first amplifier is configured to provide the operating point signal when the PWM signal is OFF and stop delivering it when the PWM signal is ON;

storing the level of the operating point on a storage capacitance element when the PWM is ON; and replenishing a leakage current of the storage capacitance element.

20. A light emitting diode (LED) driver circuit comprising:

a control signal input configured to receive a control signal;

a pulse-width modulation (PWM) input configured to receive a PWM signal;

a power stage having a first input coupled to the PWM input, a second input configured to receive an operating point signal, and an output, wherein the power stage is configured to deliver a level of current indicated by the control signal, to an LED load when the PWM signal is ON and stop delivering the level of current when the PWM signal is OFF;

a feedback circuit coupled between a second node of the output of the power stage and the second input of the power stage, wherein the feedback circuit includes:

a digital controller having a first input coupled to the PWM input;

a second input coupled to the control signal input via a first analog to digital converter (ADC);

a third input coupled to a second ADC; and an output; and wherein the feedback circuit is configured to:

generate the operating point signal to cause the power stage to deliver a level of current indicated by the control signal; and store an information indicative of a level of the operating point signal just after the PWM signal is turned OFF and cause the operating point signal to be at that level just before the PWM signal is turned ON.

21. The driver circuit of claim 20, wherein the feedback circuit further comprises a digital to analog converter (DAC) coupled between the output of the digital controller and the second input of the power stage.

* * * * *